US008827427B2

(12) United States Patent
Yoshida et al.

(10) Patent No.: US 8,827,427 B2
(45) Date of Patent: Sep. 9, 2014

(54) INK-JET HEAD AND INK-JET APPARATUS

(75) Inventors: Hidehiro Yoshida, Osaka (JP); Kazuki Fukada, Osaka (JP)

(73) Assignee: Panasonic Corporation, Osaka (JP)

( * ) Notice: Subject to any disclaimer, the term of this patent is extended or adjusted under 35 U.S.C. 154(b) by 25 days.

(21) Appl. No.: 13/092,339

(22) Filed: Apr. 22, 2011

(65) Prior Publication Data

US 2011/0267407 A1 Nov. 3, 2011

(30) Foreign Application Priority Data

Apr. 28, 2010 (JP) ..... 2010-103972

(51) Int. Cl.
*B41J 2/155* (2006.01)
*B41J 2/175* (2006.01)

(52) U.S. Cl.
CPC *B41J 2/175* (2013.01); *B41J 2/155* (2013.01); *B41J 2202/20* (2013.01)
USPC ..... 347/65; 347/87; 347/72; 347/68

(58) Field of Classification Search
USPC ..... 347/65, 40, 42, 43, 20, 87
See application file for complete search history.

(56) References Cited

U.S. PATENT DOCUMENTS

| | | | | |
|---|---|---|---|---|
| 7,334,878 | B2 * | 2/2008 | Eguchi et al. | 347/56 |
| 7,350,902 | B2 * | 4/2008 | Dietl et al. | 347/43 |
| 7,354,136 | B2 * | 4/2008 | Oishi | 347/40 |
| 7,591,549 | B2 * | 9/2009 | Komplin et al. | 347/92 |
| 7,690,768 | B2 * | 4/2010 | Eguchi et al. | 347/56 |
| 8,182,073 | B2 * | 5/2012 | Xie et al. | 347/66 |
| 8,585,182 | B2 * | 11/2013 | Koseki | 347/68 |
| 8,602,533 | B2 * | 12/2013 | Fukada et al. | 347/68 |
| 2002/0023661 | A1 | 2/2002 | Yamamoto | |
| 2005/0088484 | A1 | 4/2005 | Nagashima | |
| 2008/0136860 | A1 * | 6/2008 | Kyoso | 347/19 |
| 2008/0143793 | A1 * | 6/2008 | Okuda | 347/68 |
| 2008/0238980 | A1 * | 10/2008 | Nagashima et al. | 347/17 |
| 2008/0239007 | A1 * | 10/2008 | Tomizawa et al. | 347/56 |
| 2008/0316278 | A1 * | 12/2008 | Van Den Bergen | 347/65 |
| 2009/0141078 | A1 * | 6/2009 | Kayahara et al. | 347/40 |
| 2010/0123760 | A1 * | 5/2010 | Nakagawa et al. | 347/65 |
| 2011/0205306 | A1 * | 8/2011 | Vaeth et al. | 347/68 |

(Continued)

FOREIGN PATENT DOCUMENTS

| | | | |
|---|---|---|---|
| JP | 2002-66478 | A | 3/2002 |
| JP | 2004-136668 | A | 5/2004 |

(Continued)

*Primary Examiner* — Matthew Luu
*Assistant Examiner* — Lily Kemathe
(74) *Attorney, Agent, or Firm* — Pearne & Gordon LLP

(57) ABSTRACT

An ink-jet head comprising: a supply channel configured to allow ink to flow; ink chamber groups, each having two or more ink chambers that are alternately provided on either side of the supply channel, along a direction of the ink, the ink chambers each having nozzles for discharging ink; wherein: each of the ink chamber groups has two or more ink chamber sequences in parallel with the direction, and two or more nozzle sequences in parallel with the direction, in each of the ink chamber groups, when the ink chamber sequence closest to the supply channel is a first ink chamber sequence, and the ink chamber sequence furthest away from the supply channel is an n-th ink chamber sequence, the number of the ink chambers in the first ink chamber sequence is greater than the number of the ink chambers in the n-th ink chamber sequence.

9 Claims, 11 Drawing Sheets

(56) References Cited

U.S. PATENT DOCUMENTS

| | | | | |
|---|---|---|---|---|
| 2011/0228012 | A1* | 9/2011 | Yoshida et al. | 347/68 |
| 2011/0234705 | A1* | 9/2011 | Fukada et al. | 347/68 |
| 2012/0120158 | A1* | 5/2012 | Sakai et al. | 347/65 |

FOREIGN PATENT DOCUMENTS

| | | | |
|---|---|---|---|
| JP | 2005-125762 | A | 5/2005 |
| JP | 2006-082459 | A | 3/2006 |
| JP | 2008-254196 | A | 10/2008 |

* cited by examiner

INK-JET HEAD AND INK-JET APPARATUS

CROSS REFERENCE TO RELATED APPLICATIONS

This application is entitled and claims the benefit of Japanese Patent Application No. 2010-103972, filed on Apr. 28, 2010, the disclosure of which including the specification, drawings and abstract is incorporated herein by reference in its entirety.

TECHNICAL FIELD

The technical field relates to an ink-jet head and an ink-jet apparatus having the same.

BACKGROUND ART

An ink-jet head may have an ink supply channel through which ink is supplied from an ink supply source; a plurality of ink chambers, each having a nozzle to discharge ink and arranged along the ink supply channel; and actuators (e.g., piezoelements) provided in the respective ink chambers. A series of ink chambers arranged along the ink supply channel may also be referred to as "ink chamber sequence." In addition, ink chambers each having a nozzle are arranged along the ink supply channel, and therefore so are the nozzles. A series of nozzles arranged along the ink supply channel may also be referred to as "nozzle sequence."

In this ink-jet head, actuators apply pressure to the ink in ink chambers to discharge the ink from nozzles. The resolution of this ink-jet head is determined based on the placement pitch of nozzles (hereinafter referred to as "nozzle pitch").

In addition, a technique has been known where trapezoid-shaped ink chamber groups, each having a plurality of ink chamber sequences, are alternately provided (see, for example, Patent Literature 1). FIG. 1 is a plane view of ink-jet head 70 disclosed in Patent Literature 1.

As shown in FIG. 1, ink chamber groups 21, each having a matrix of ink chambers, are alternately provided in ink-jet head 70. Ink supply channel 5 is formed between ink chamber groups 21. In addition, each ink chamber group 21 has one piezoelectric element unit having a trapezoid shape in plan view.

If air is mixed into ink in the ink-jet head and nozzles in the ink-jet head clog, the ink-jet head might not discharge ink appropriately. Therefore, it has been suggested that air inclusion and nozzle clogging are prevented by circulating ink in the ink-jet head (that is, by supplying ink from outside and discharging ink from the ink-jet head) (see, for example, Patent Literature 2).

CITATION LIST

Patent Literature

PTL 1: Japanese Patent Application Laid-Open No. 2004-136668

PTL 2: Japanese Patent Application Laid-Open No. 2008-254196

PTL 3: U.S. Patent Application Publication No. 2008/0238980

SUMMARY OF INVENTION

Technical Problem

In recent years, development of an ink-jet head with a small nozzle pitch has been demanded to increase the resolution of printers. A nozzle is provided per ink chamber as described above, and therefore, the size of an ink chamber is reduced to reduce the nozzle pitch for a nozzle sequence (ink chamber sequence), so that the nozzle pitch for the ink-jet head is shortened. However, taking into account the volume required for actuators and ink chambers, there is limitation on reduction in the size of an ink chamber, and consequently there is limitation on reduction in the pitch for a nozzle sequence.

In order to make the nozzle pitch for the ink-jet head smaller than the limit of the nozzle pitch for a nozzle sequence, a plurality ink chamber sequences (nozzle sequences) may be provided in the ink-jet head with their nozzle positions staggered. FIG. 2A is a perspective view of ink-jet head 10 having a plurality of ink chamber sequences and nozzle sequences. FIG. 2B is a plane view of ink-jet head 10 from a nozzle forming surface.

As shown in FIG. 2A and FIG. 2B, ink-jet head 10 has ink supply channel 101, first ink chamber sequence 111, second ink chamber sequence 112, first nozzle sequence 121 and second nozzle sequence 122. Ink chambers 113 in first ink chamber sequence 111 are connected to ink supply channel 101. In addition, in ink-jet head 10 shown in FIG. 2A and FIG. 2B, in order to allow ink to be supplied to ink chambers 113 in second ink chamber sequence 112, ink chambers 113 in first ink chamber sequence 111 communicate with ink chambers 113 in second ink chamber sequence 112. Therefore, it is possible to supply ink from ink supply channel 101 to second ink chamber sequence 112 through first ink chamber sequence 111.

As shown in FIG. 2B, as seen from the ink supply channel 101 side, nozzles 123 in first nozzle sequence 121 do not overlap nozzles 123 in second nozzle sequence 122. To be more specific, each nozzle 123 in first nozzle sequence 121 is positioned between two adjacent nozzles 123 in second nozzle sequence 122. In this way, by providing a plurality of nozzle sequences and preventing the positions of nozzles from overlapping each other, it is possible to reduce nozzle pitch P1 for the ink-jet head to ½ of nozzle pitch P2 for a nozzle sequence, and consequently provide a high-resolution ink-jet head.

Next, ink flow in ink-jet head 10 will be described. In ink-jet head 10, ink is first supplied from ink supply channel 101 to ink chambers 113 in first ink chamber sequence 111. As described above, ink chambers in first ink chamber sequence 111 communicate with ink chambers 113 in second ink chamber sequence 112, and therefore ink passes through ink chambers 113 in first ink chamber sequence 111 and then, is supplied to ink chambers 113 in second ink chamber sequence 112.

Meanwhile, the ink supplied to ink chambers 113 in first ink chamber sequence 111 is partly discharged from nozzles 123 (in first nozzle sequence 121) in ink chambers 113 in first ink chamber sequence 111. Therefore, the amount of the ink supplied to ink chambers 113 in second ink chamber sequence 112 is smaller than the amount of the ink supplied to ink chambers 113 in first ink chamber sequence 111.

As a result of this, in ink-jet head 10 shown in FIG. 2A and FIG. 2B, the pressure of the ink in ink chambers 113 in first ink chamber sequence 111 increases, and the pressure of the ink in ink chambers 113 in second ink chamber sequence 112 decreases.

In this way, if the pressure of ink is different between ink chambers, the amount and speed of ink discharged from nozzles, vary among nozzles. If the amount and speed of ink discharged from nozzles vary among nozzles, it is not possible to provide accurate printing.

It is therefore an object of the present invention to provide a high-resolution ink-jet head in which the amount and speed of ink discharged from nozzles are the same among nozzles.

Solution to Problem

A first of the present invention relates to the ink-jet head given below.

[1] An ink-jet head comprising:

an ink supply channel configured to allow ink supplied from outside to flow;

ink chamber groups, each having two or more ink chambers that are alternately provided on either side of the ink supply channel, along a direction in which ink flows through the ink supply channel, the ink chambers each having nozzles for discharging ink; and an actuator provided in each of the ink chambers, wherein:

each of the ink chamber groups has two or more ink chamber sequences in parallel with the direction, and two or more nozzle sequences in parallel with the direction, each of the ink chamber sequences being constituted by the ink chambers arranged in a row and each of the nozzle sequences being constituted by the nozzles arranged in a row;

in each of the ink chamber groups, adjacent ink chambers communicate with one another; and wherein an ink chamber sequence closest to the ink supply channel is a first ink chamber sequence, an ink chamber sequence furthest away from the ink supply channel is an n-th ink chamber sequence, and the number of the ink chambers in the first ink chamber sequence is greater than the number of the ink chambers in the n-th ink chamber sequence.

[2] The ink-jet head according to [1], wherein positions of the nozzles in one of the nozzle sequences do not overlap positions of the nozzles in the other nozzle sequences, when seen in a direction perpendicular to the direction in which ink flows through the ink supply channel.

[3] The ink-jet head according to one of [1] and [2], wherein:

the ink chamber group provided on one side of the ink supply channel partly overlaps the ink chamber group provided on the other side of the ink supply channel; and when a region of the ink-jet head provided with two or more ink chamber groups, is divided into a plurality of pieces at even intervals in a direction perpendicular to the direction in which ink flows through the ink supply channel, each of the pieces has same number of ink chambers and same number of nozzles.

[4] The ink-jet head according to one of [1] to [3], further comprising an ink discharging channel in parallel with the direction and configured to allow ink discharged from the ink chambers to flow, wherein the ink discharging channel is connected to the ink chambers in the n-th ink chamber sequence.

A second of the present invention relates to an ink-jet apparatus given below.

[5] An ink-jet apparatus comprising the ink-jet head according to one of [1] to [4].

Advantageous Effects of Invention

With the ink-jet head according to the present invention, the pressure of ink is the same among ink chambers, and the amount and speed of droplets discharged from nozzles are the same among nozzles.

DESCRIPTION OF EMBODIMENTS

1. Ink-Jet Head

Figure 1:
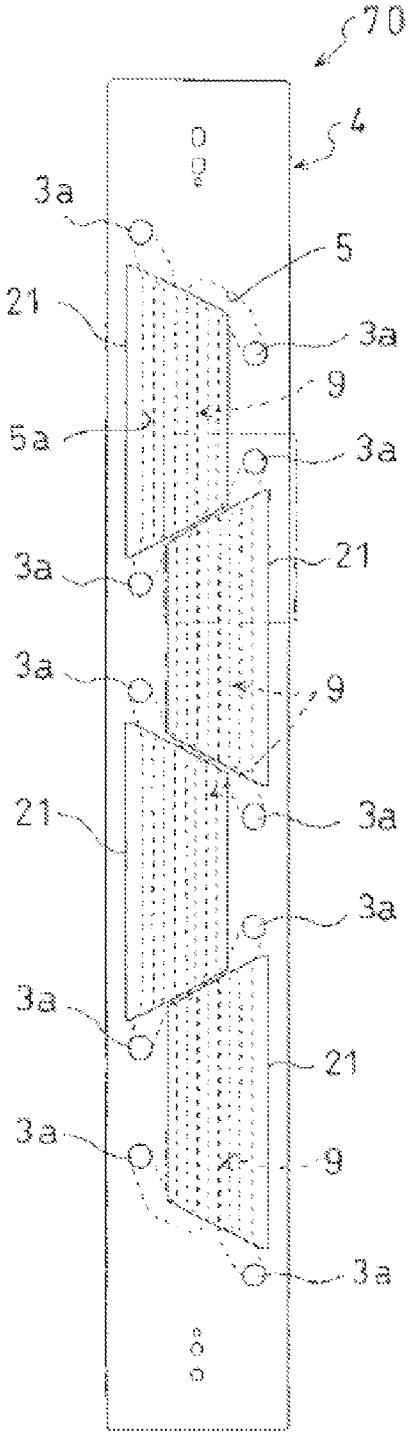
FIG. 1 is a plane view of a conventional ink-jet head.
Figure 2A:
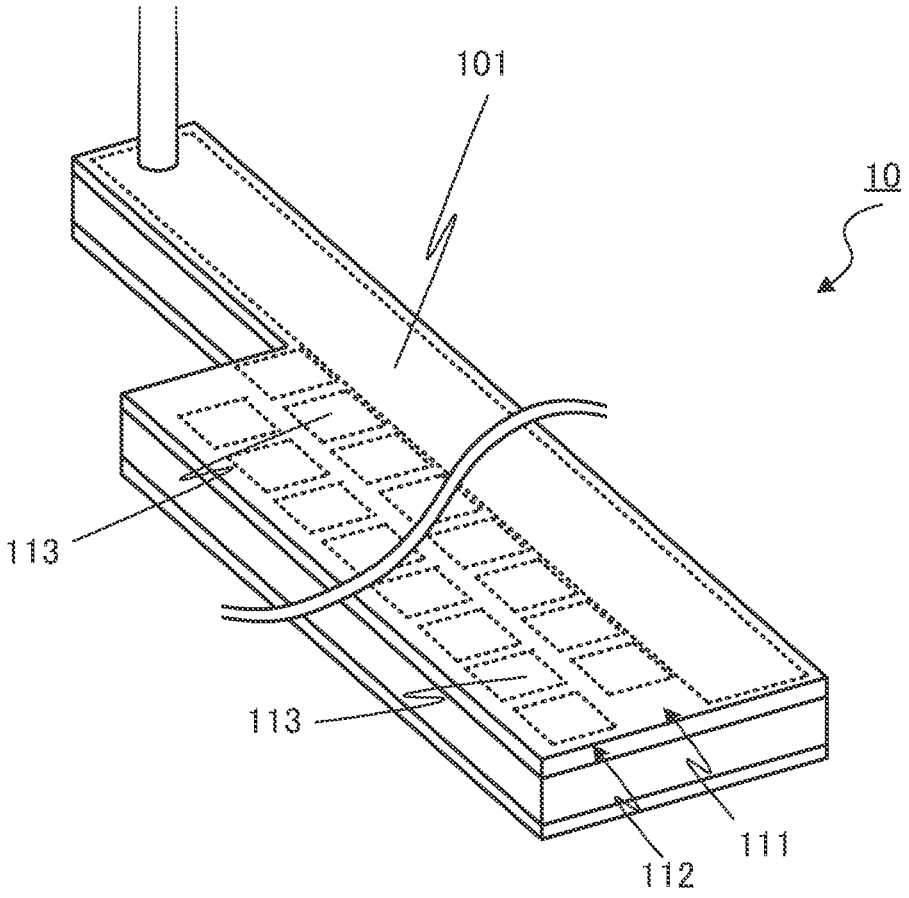
FIG. 2A is a perspective view of an ink-jet head having two ink chamber sequences and two nozzle sequences.
Figure 2B:
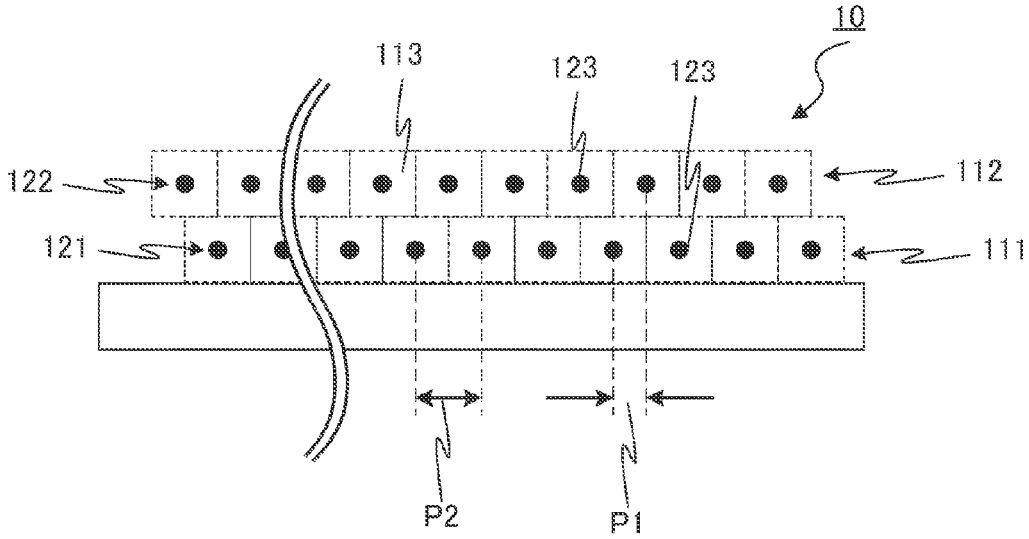
FIG. 2B is an enlarged plane view of the ink-jet head shown in FIG. 2A, from a surface having nozzles.

The ink-jet head according to the present invention has 1) ink supply channel, 2) ink chamber groups and 3) actuators.

The present invention is characterized in that ink chamber groups each including a plurality of ink chambers have an innovative structure, so that the amount and speed of ink discharged from nozzles in ink chambers are the same among nozzles. Now, components of the present invention will be described.

1) Ink Supply Channel

An ink supply channel is a channel configured to allow ink supplied from outside to flow. The ink flowing through the ink supply channel is supplied to ink chambers in ink chamber groups described later. The ink supply channel has an inlet to which ink is supplied from outside. The flow rate of ink supplied to the ink supply channel is not particularly limited, and it may be several ml/min or more.

2) Ink Chamber Group

An ink chamber group is a region including a plurality of ink chambers each having a nozzle to discharge ink. Ink chamber groups are alternately provided on either side of the ink supply channel, along the direction in which ink flows through the ink supply channel (hereinafter also referred to as "ink flow direction") (see FIG. 4A and FIG. 7).

An ink chamber is a space to accommodate ink to be discharged from an nozzle. The ink chambers included in the ink-jet head according to the present invention have generally the same dimension. The kinds of ink accommodated in ink chambers are not particularly limited, and are appropriately selected depending on the kind of a print medium.

A nozzle is an outlet to discharge ink from an ink chamber. Generally, in an ink-jet head, one nozzle is provided for one ink chamber. Ink in an ink chamber is discharged from the nozzle. The diameter of a nozzle is not limited. The diameter of a nozzle may be, for example, about 10 to 100 μm.

In the present invention, an ink chamber group has a plurality of ink chamber sequences in parallel with each other and a plurality of nozzle sequences in parallel with each other.

An ink chamber sequence is constituted by the ink chambers arranged in a row. The number of ink chambers included in one ink chamber sequence is, for example, 2 to 10. In addition, ink chamber sequences are in parallel with the ink flow direction. Hereinafter, among ink chamber sequences, the ink chamber sequence closest to the ink supply channel is also referred to as "first ink chamber sequence", and the ink chamber sequence furthest away from the ink supply channel is also referred to as "n-th (where n is an integer equal to or greater than 2) ink chamber sequence." The ink supply channel is connected to the ink chambers in the first ink chamber sequence. On the other hand, the ink chambers in an n-th ink chamber sequence are not connected to the ink supply channel.

A nozzle sequence is constituted by the nozzles arranged in a row. In addition, nozzle sequences are in parallel with the ink flow direction. Hereinafter, among nozzle sequences, the nozzle sequence closest to the ink supply channel is also referred to as "first nozzle sequence", and the nozzle sequence furthest away from the ink supply channel is also referred to as "n-th nozzle sequence."

An ink chamber generally has one nozzle as described above, and therefore, the number of ink chamber sequences and the number of nozzle sequences are usually the same. The number of ink chamber sequences and the number of nozzle sequences in an ink chamber group are not limited, and may be, for example, 2 to 10. In addition, each of the ink chamber groups usually has same number of ink chamber sequences and same number of nozzle sequences.

It is preferable that the positions of the nozzles in one nozzle sequence with respect to the ink flow direction (hereinafter referred to as "nozzle positions") do not overlap the positions of the nozzles in the other nozzle sequences (see FIG. 4A and FIG. 7). Therefore, the positions of the nozzles in one nozzle sequence do not overlap the positions of the nozzles in the other nozzle sequences, when seen in a direction perpendicular to the ink flow direction. By preventing the nozzle positions from overlapping each other, it is possible to make the nozzle pitch for an ink chamber group smaller than the nozzle pitch for a nozzle sequence, so that it is possible to improve the resolution of the inkjet head.

As described above, a feature of the ink-jet head according to the present invention lies in the structure of an ink chamber group. The feature of ink chamber groups will be explained in detail in "2. Structure of an ink chamber group" described later.

3) Actuator

The ink-jet head according to the present invention has an actuator provided in each ink chamber. In the present invention, one or more actuators are provided in each ink chamber. An actuator is an actuating device that converts a driving signal to physical force. An actuator may be a heater (heating element) or piezoelement (piezoelectric element), while a piezoelement is desired. An inkjet head that employs a heater as an actuator is called the "thermal ink-jet head," where ink in the ink chamber is heated by the heater to form a bubble that applies a pressure to the ink, allowing an ink droplet to be discharged from the nozzle. Therefore, there is concern that certain types of ink are degraded due to heat. On the other hand, an inkjet head that employs a piezoelement as an actuator is called the "piezoelectric ink-jet head," where the volume of the ink chamber is changed by deformation of the piezoelement, thereby applying a pressure to ink to discharge ink droplets.

In addition, piezoelements used as an actuator are classified roughly into shear mode, push mode and bend mode, depending on the output form (deformation mode). The ink-jet head according to the present invention may adopt a piezoelement that operates in any mode.

A piezoelement used as an actuator may be classified into a thin film piezoelement and a multilayer piezoelement. The thin film piezoelement rapidly expands in response to input, but the output level tends to be low. Therefore, when using the thin film piezoelement, discharge of ink tends to be uneven depending on the pressure and the viscosity of ink in the ink chamber from which the ink is discharged. Therefore, it may not be possible to discharge ink appropriately depending on the kinds of ink. On the other hand, the multilayer piezoelement slowly expands in response to input, but can easily produce a high output level. Therefore, the multilayer piezoelement is less susceptible to the pressure of ink in the ink chamber from which the ink is discharged, and therefore can realize uniform discharge. Therefore, the multilayer piezoelement may be preferable to the thin film piezoelement, as an actuator used in the ink-jet head according to the present invention.

Figure 5A:
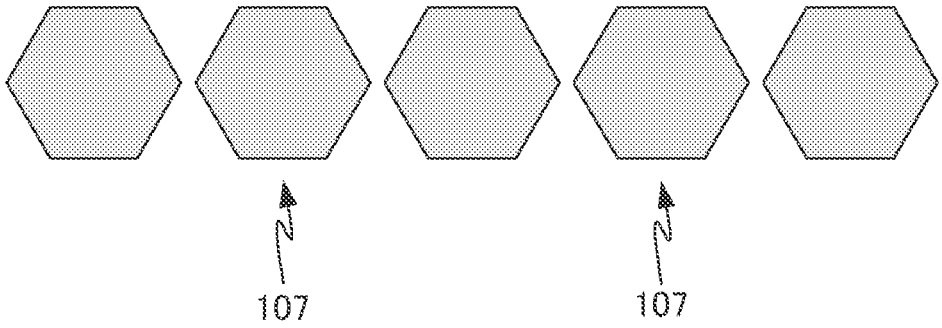
FIG. 5A is a plane view of piezoelements in the ink-jet head according to Embodiment 1.
Figure 5B:
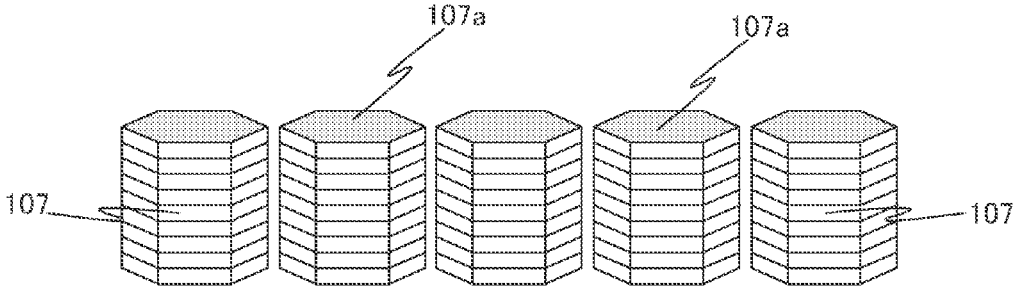
FIG. 5B is a perspective view of the piezoelements shown in FIG. 5A.

When the multilayer piezoelement is used as an actuator, it is preferable that the multilayer piezoelement has a hexagonal shape in plan view (see FIG. 5A and FIG. 5B). It is because that the multilayer piezoelement having a hexagonal shape in plan view allows increase in the area of its working surface (the surface to push ink), so that it is possible to apply higher pressure to ink.

Figure 3:
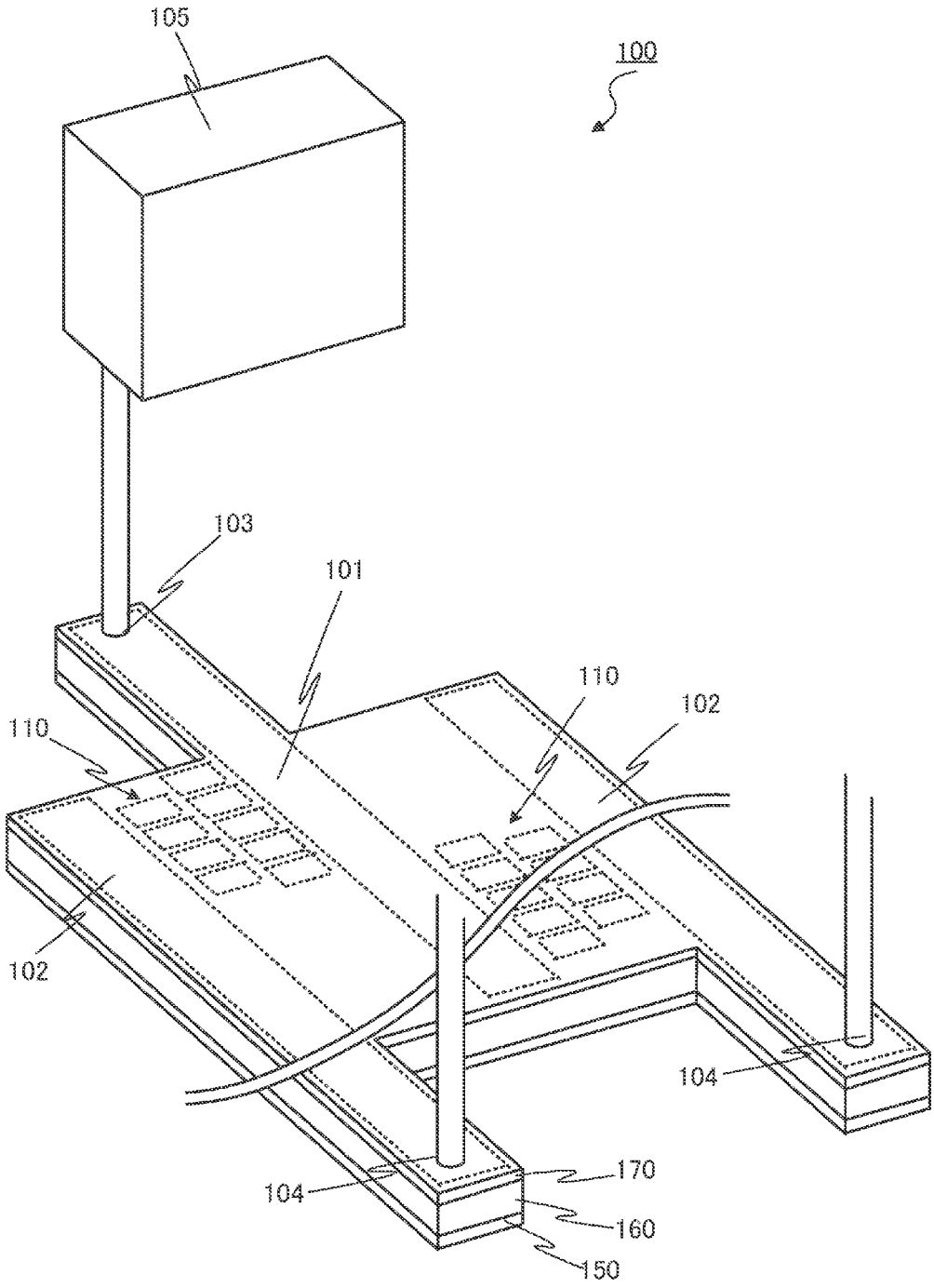
FIG. 3 is a perspective view of an ink-jet head according to Embodiment 1.

In addition, the ink-jet head according to the present invention may have ink discharging channels (see FIG. 3). An ink discharging channel is a flow channel configured to allow the ink discharged from ink chambers in an ink chamber group to flows and is in parallel with the ink flow direction. An ink discharging channel has an outlet to discharge ink outside. The ink chambers in an n-th ink chamber sequence are connected to an ink discharging channel. By providing ink discharging channels, it is possible to supply new ink into ink chambers continuously, and it is possible to prevent discharge failure due to air inclusion and ink stagnation.

In a case in which the ink-jet head has ink discharging channels, two ink discharging channels are provided for one ink supply channel (see FIG. 3).

2. Structure of Ink Chamber Groups

Figure 4A:
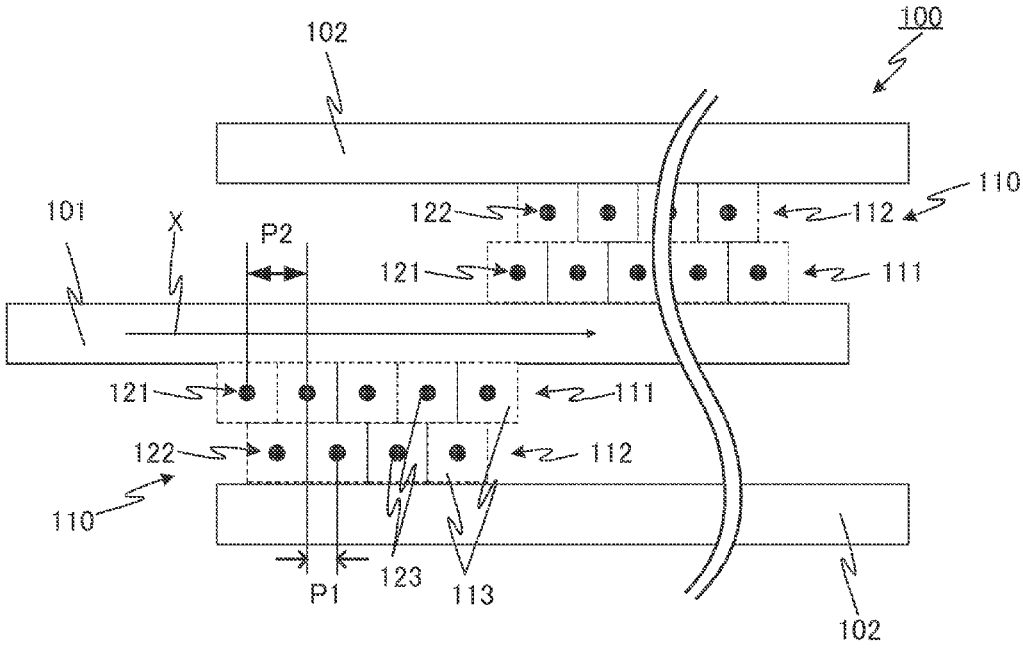
FIG. 4A is a partial enlarged plane view of the ink-jet head shown in FIG. 3, from the bottom plate.
Figure 4B:
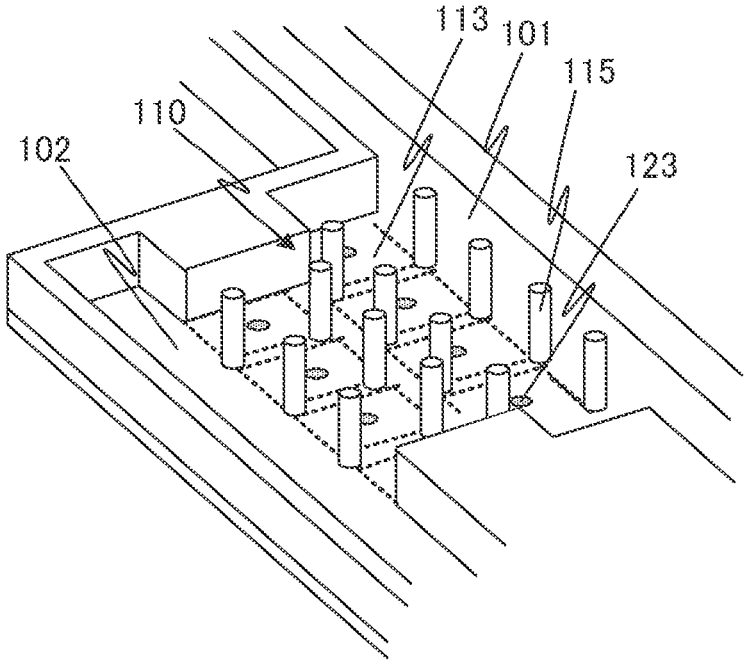
FIG. 4B is a perspective view of the interior of an ink chamber group in the ink jet head shown in FIG. 3.

The present invention is characterized in that adjacent ink chambers communicate with one another, in an ink chamber group (see FIG. 4B). To be more specific, two adjacent ink chambers in an ink chamber sequence communicate with each other, and ink chambers in two adjacent ink chamber sequences communicate with each other (see FIG. 4B). Therefore, it is possible to supply ink from the ink supply channel to the ink chambers in all ink chamber sequences without providing an additional ink channel in an ink chamber group.

In addition, the present invention is characterized in that the number of ink chambers in an ink chamber sequence varies depending on the position of the ink chamber sequence. To be more specific, the number of ink chambers in the first ink chamber sequence is maximum, and the number of ink chambers in an n-th ink chamber sequence is minimum. Therefore, the number of ink chambers in the first ink chamber sequence is greater than the number of ink chambers in an n-th ink chamber sequence. In addition, it is preferable that the number of ink chambers in an ink chamber sequence gradually reduces from the first ink chamber sequence to an n-th ink chamber sequence. In this way, the number of ink chambers in an ink chamber sequence is adjusted depending on the order of the ink chamber sequence, and consequently it is possible to make uniform the amount of ink discharged from all the nozzles of an ink chamber group.

Figure 7:
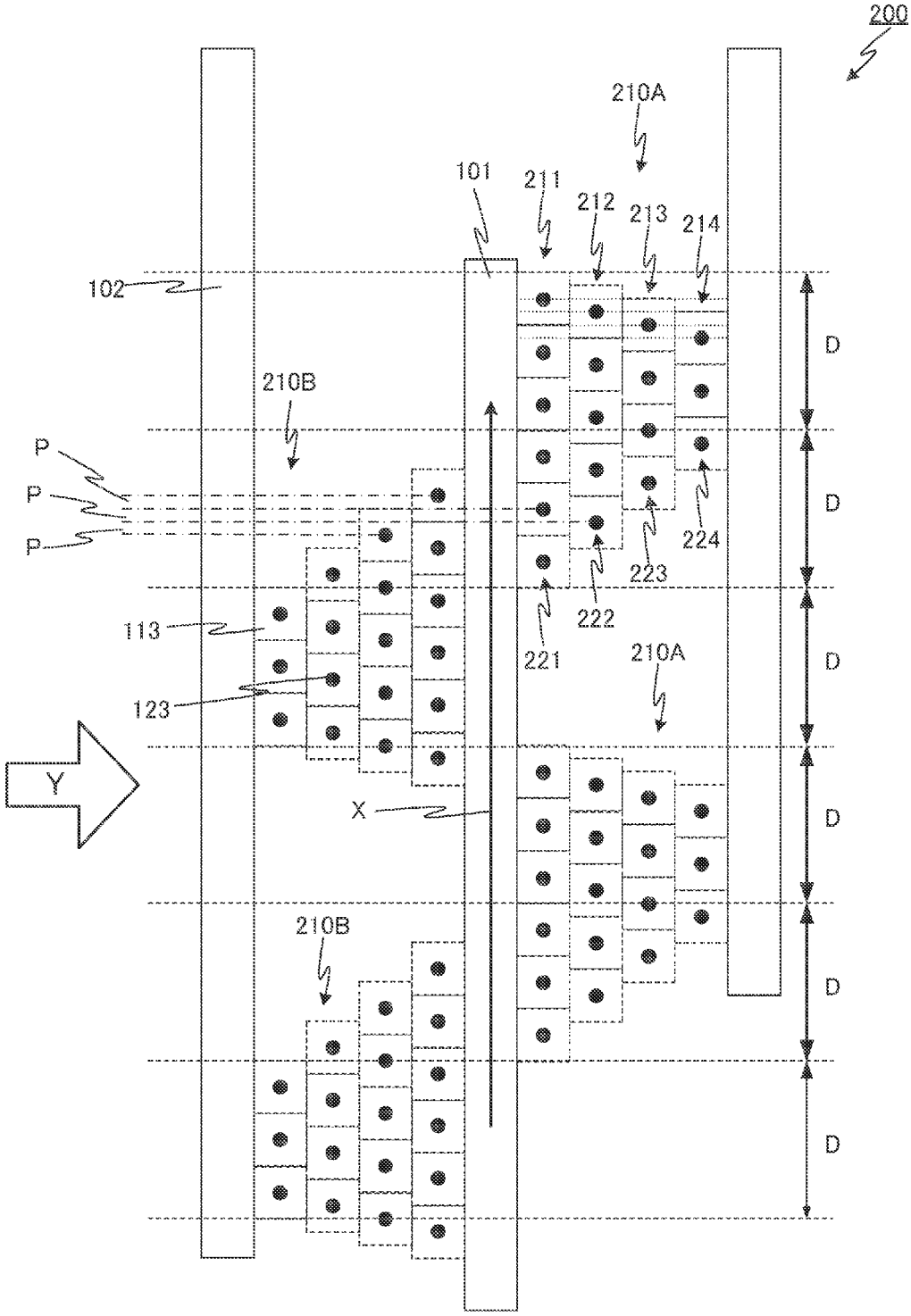
FIG. 7 is a plane view of an ink-jet head according to Embodiment 2.
Figure 8:
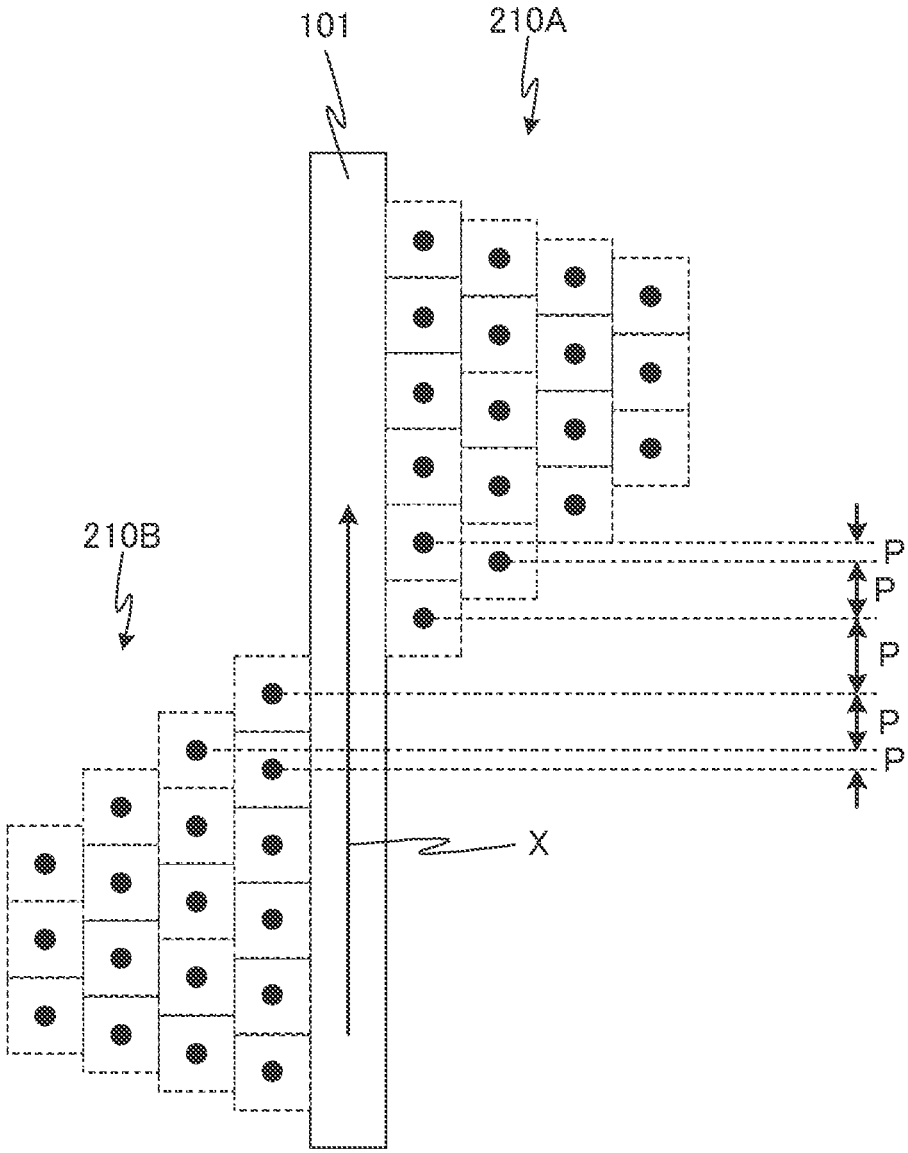
FIG. 8 is a plane view of an ink-jet head in which ink chamber groups do not overlap each other.

Moreover, in the present invention, as seen from the direction perpendicular to the ink flow direction (the direction in which ink chamber sequences appear to overlap), ink chamber groups provided on one side of the ink supply channel partly overlap ink chamber groups provided on the other side of the ink supply channel so as to make the nozzle pitch of the ink-jet head constant (see FIG. 7). In this way, as a result of partly overlapping ink chamber groups such that the nozzle pitch for the ink-jet head is constant, when the nozzle forming region in the ink-jet head (the region in which a plurality of ink chamber groups are alternately provided on either side of the ink supply channel along the ink flow direction) is divided into a plurality of pieces at even intervals in the direction perpendicular to the ink flow direction, each of the pieces has same number of ink chambers and nozzles (see FIG. 7).

3. Ink-Jet Apparatus

A feature of the ink-jet apparatus according to the present invention is to include the above-described ink-jet head. Moreover, the ink jet apparatus optionally includes components used in well-known ink-jet apparatuses. For example, the ink-jet apparatus has a member for fixing the ink-jet head, a transfer stage for transferring a print medium placed thereon, and so forth.

The ink jet apparatus may have an ink circulating device. The ink circulating device circulates ink by supplying driving pressure to the ink. Although a pump may be used in order to supply driving pressure to ink, it is preferable to use a regulator that supplies pressure using compressed air. It is because that use of a regulator allows driving pressure to be constant, and therefore the ink circulation speed is stabilized.

In the ink-jet apparatus, ink in the ink-jet head may be circulated continuously or intermittently during operation.

Now, embodiments of the present invention will be described with reference to the accompanying drawings. However, the present invention is not limited to illustrated embodiments.

Embodiment 1

With Embodiment 1, a configuration will be described where each ink chamber group has two ink chamber sequences and two nozzle sequences.

FIG. 3 is a perspective view of ink-jet head 100 according to Embodiment 1 of the present invention. As shown in FIG. 3, ink-jet head 100 has ink supply channel 101, two ink discharging channels 102, ink chamber groups 110 and actuators (not shown).

Ink supply channel 101 has ink inlet 103 linked with ink tank 105. Ink discharging channel 102 has ink outlet 104. Ink-jet head 100 is fabricated by stacking, in order, bottom plate 150, spacer 160 and top plate 170.

FIG. 4A is a plane view of ink-jet head 100 shown in FIG. 3, from the bottom plate 150 side. As shown in FIG. 4A, ink-jet head 100 has a plurality of ink chamber groups 110 alternately provided on either side of ink supply channel 101, along ink flow direction X.

Each ink chamber group 110 has first ink chamber sequence 111 and second ink chamber sequence 112, and first nozzle sequence 121 and second nozzle sequence 122.

As shown in FIG. 4A, the positions of nozzles 123 in first nozzle sequence 121 with respect to direction X do not overlap the positions of nozzles 123 in second nozzle sequence 122 with respect to direction X. To be more specific, as seen from the ink supply channel 101 side, each nozzle 123 in second nozzle sequence 122 is positioned between two adjacent nozzles 123 in first nozzle sequence 121. Therefore, nozzle pitch P1 for an ink chamber group is ½ of nozzle pitch P2 for a nozzle sequence, and therefore, it is possible to improve the resolution of ink-jet head.

In addition, as shown in FIG. 4A, the number of ink chambers 113 in first ink chamber sequence 111 is greater than the number of ink chambers 113 in second ink chamber sequence 112. To be more specific, first ink chamber sequence 111 has five ink chambers 113, while second ink chamber sequence 112 has only four ink chambers 113. In this way, the number of ink chambers 113 in first ink chamber sequence 111 is greater than the number of ink chambers 113 in second ink chamber sequence 112, so that it is possible to fix the ink pressure in ink chambers 113 in each ink chamber sequence, and it is possible to make the amount and speed of ink discharged from respective nozzles constant.

FIG. 4B is a perspective view of ink chamber group 110 in ink-jet head 100 without top plate 170. As shown in FIG. 4B, ink chambers 113 are merely partitioned by columns 115 in ink chamber group 110, and are not separated by walls. Therefore, in ink chamber group 110, adjacent ink chambers 113 communicate one another. Column 115 may be a cylinder or a prism, while a cylinder is desired. It is because that ink can flow smoothly through ink chambers by partitioning ink chambers by cylindrical columns.

In addition, as shown in FIG. 4B, ink chambers 113 in first ink chamber sequence 111 are connected to ink supply channel 101, and ink chambers 113 in second ink chamber sequence 112 are connected to ink discharging channel 102.

FIG. 5A is a plane view of multilayer piezoelements 107, which are actuators according to the present embodiment; and FIG. 5B is a perspective view of multilayer piezoelements 107 shown in FIG. 5A. As shown in FIG. 5A and FIG. 5B, it is preferable that multilayer piezoelement 107 has a hexagonal shape in plan view. It is because that multilayer piezoelement 107 having a hexagonal shape in plan view allows increase in the area of the working surface (surface to push ink) 107*a* of multilayer piezoelement 107, so that it is possible to apply higher pressure to ink.

Figure 6:
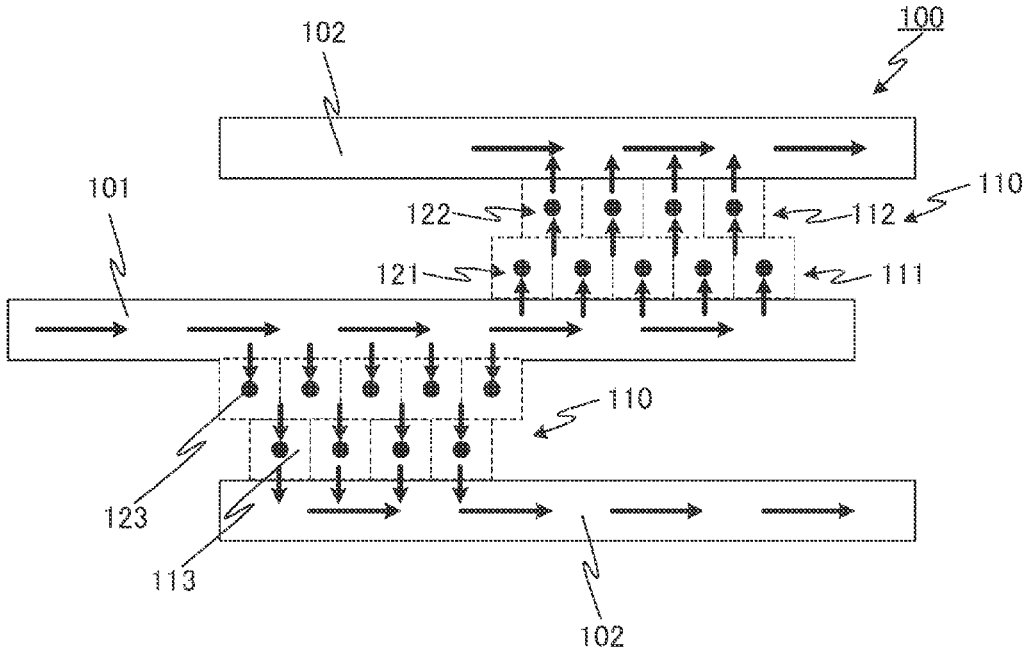
FIG. 6 shows ink flow in the ink-jet head according to Embodiment 1.

Next, ink flow in ink-jet head 100 will be described with reference to FIG. 6. FIG. 6 is a drawing in which ink flows indicated by arrows are added to the plane view of ink-jet head 100 shown in FIG. 4A.

As shown in FIG. 6, ink is supplied from ink supply channel 101 to ink chambers 113 in first ink chamber sequence 111. In addition, as described above, ink chambers 113 in first ink chamber sequence 111 communicate with ink chambers 113 in second ink chamber sequence 112, and therefore ink passes through ink chambers 113 in first ink chamber sequence 111 and then is supplied to ink chambers 113 in second ink chamber sequence 112, and finally, flows into ink discharging channels 102.

Meanwhile, the ink supplied to ink chambers 113 in first ink chamber sequence 111 is partly discharged from nozzles 123 (in first nozzle sequence 121) in ink chambers 113 in first ink chamber sequence 111. Therefore, the amount of ink supplied to ink chambers 113 in second ink chamber sequence 112 is smaller than the amount of ink supplied to ink chambers 113 in first ink chamber sequence 111. As a result of this, if first ink chamber sequence 111 and second ink chamber sequence 112 have the same number of ink chambers 113, the ink pressure in second ink chamber sequence 112 decreases compared to the ink pressure in first chamber sequence 111.

In this way, if the ink pressure varies between first ink chamber sequence 111 and second ink chamber sequence 112, the amount and speed of ink discharged from nozzles, as droplets vary among nozzles. That is, a relatively large amount of ink is discharged from nozzles 123 in first nozzle sequence 121 at high speed; and a relatively small amount of ink is discharged from nozzles 123 in second nozzle sequence 122 at low speed.

By contrast with this, in the present invention, the number of ink chambers 113 in second ink chamber sequence 112 is smaller than the number of ink chambers 113 in first ink chamber sequence 111. This prevents decrease in the ink pressure in ink chambers 113 in second ink chamber sequence 112, even if the amount of ink supplied to ink chambers 113 in second ink chamber sequence 112 is smaller than the amount of ink supplied to ink chambers 113 in first ink chamber sequence 111. Accordingly, the amount and speed of ink discharged from nozzles are the same among nozzles.

Embodiment 2

With Embodiment 1, a configuration has been explained where one ink chamber group has two ink chamber sequences and two nozzle sequences. With Embodiment 2, another configuration will be explained where one ink chamber group has four ink chamber sequences and four nozzle sequences.

FIG. 7 is a plane view of ink-jet head 200 according to Embodiment 2, from the bottom plate side. The basic structure of ink-jet head 200 according to Embodiment 2 is the same as ink-jet head 100 according to Embodiment 1, except that ink chamber group 210 has four nozzle sequences and four ink chamber sequences. Therefore, the same components as in ink-jet head 100 according to Embodiment 1 are assigned the same reference numerals and their descriptions will be omitted.

As shown in FIG. 7, ink chamber group 210 in ink-jet head 200 has four ink chamber sequences (first ink chamber sequence 211, second ink chamber sequence 212, third ink chamber sequence 213 and fourth ink chamber sequence 214), and four nozzle sequences (first nozzle sequence 221, second nozzle sequence 222, third nozzle sequence 223 and fourth nozzle sequence 224).

In addition, as shown in FIG. 7, as seen from the ink supply channel side, the positions of nozzles 123 in respective four nozzle sequences do not overlap each other. Therefore, the nozzle pitch for an ink chamber group is ¼ of the nozzle pitch for a nozzle sequence. Therefore, ink-jet head 200 according to the present embodiment has a higher resolution than ink-jet head 100 according to Embodiment 1.

Moreover, with the present embodiment, ink chamber group 210A provided on one side of ink supply channel 101 partly overlaps ink chamber group 210B provided on the other side of ink supply channel 101 such that nozzle pitch P is constant in ink-jet head 200. Here, "ink chamber group 210A partly overlaps ink chamber group 210B" means that, as seen from the direction of arrow Y shown in FIG. 7, ink chamber group 210A partly overlaps ink chamber group 210B. By making ink chamber group 210A partly overlap ink chamber group 210B such that nozzle pitch P is constant, when the nozzle forming region in the ink-jet head is divided into a plurality of pieces at even intervals D in the direction perpendicular to ink flow direction X, each of the pieces has same number of ink chambers and nozzles.

On the other hand, when ink chamber group 210A does not overlap ink chamber group 210B, there is a region in which nozzle pitch P for the ink-jet head is not constant, and therefore the resolution of the ink-jet head varies.

INDUSTRIAL APPLICABILITY

The ink jet head according to the present invention can fix the amount and speed of ink droplets discharged from each nozzle. Therefore, the ink-jet head according to the present invention can uniformly apply ink to a print medium.

REFERENCE SIGNS LIST

100, 200 Ink-jet head
101 Ink supply channel
102 Ink discharging channel
103 Ink inlet
104 Ink outlet
105 Ink tank
107 Multilayer piezoelement
110, 210 Ink chamber group
111, 211 First ink chamber sequence
112, 212 Second ink chamber sequence
213 Third ink chamber sequence
214 Fourth ink chamber sequence
113 Ink chamber
115 Column
121, 221 First nozzle sequence
122, 222 Second nozzle sequence
223 Third nozzle sequence
224 Fourth nozzle sequence
123 Nozzle
107 Multilayer piezoelement
150 Bottom plate
160 Spacer
170 Top plate

The invention claimed is:

1. An ink-jet apparatus comprising:

an ink supply channel configured to allow ink supplied from outside to flow therethrough;

ink chamber groups that are provided on either side of the ink supply channel, the ink chamber groups each having two or more ink chambers, the ink chambers each having nozzles;

an actuator provided in each of the ink chambers; and at least two ink discharging channels in parallel with a direction in which ink flows through the ink supply channel and configured to allow ink discharged from the ink chambers to flow, the ink supply channel being arranged between the two ink discharging channels, and an ink circulating device that circulates the ink flowing through the ink supply channel and the at least two ink discharging channels, wherein:

each of the ink chamber groups has two or more ink chamber sequences arranged along the direction in which ink flows through the ink supply channel, and two or more nozzle sequences arranged along the direction in which ink flows through the ink supply channel;

adjacent ink chambers communicate with one another; and wherein one of the ink chamber sequences closest to the ink supply channel is a first ink chamber sequence, one of the ink chamber sequences furthest away from the ink supply channel is an n-th ink chamber sequence, and the number of the ink chambers in the first ink chamber sequence is greater than the number of the ink chambers in the n-th ink chamber sequence, wherein the ink discharging channels are connected to the ink chambers in the n-th ink chamber sequence, wherein the ink supply channel is configured to allow the ink to flow into all of the ink chambers of all of the ink chamber groups so as to flow into the at least two ink discharging channels through the all of the ink chambers, and wherein a flow direction of the ink in the ink supply channel and a flow direction of the ink in the at least two ink discharging channels are limited to one identical direction.

2. The ink-jet apparatus according to claim 1, wherein positions of the nozzles in one of the nozzle sequences do not overlap positions of the nozzles in the other nozzle sequences, when seen in a direction perpendicular to the direction in which ink flows through the ink supply channel.

3. The ink-jet apparatus according to claim 1, wherein:

the ink chamber group provided on one side of the ink supply channel partly overlaps the ink chamber group provided on the other side of the ink supply channel; and when a region of the ink-jet head provided with two or more ink chamber groups, is divided into a plurality of pieces at even intervals in a direction perpendicular to the direction in which ink flows through the ink supply channel, each of the pieces has same number of ink chambers and same number of nozzles.

4. The ink-jet apparatus according to claim 1, wherein the actuator is a piezoelectric element.

5. The ink-jet apparatus according to claim 1, an ink chamber group, further comprising:

the first ink chamber sequence;

a second ink chamber sequence that is located further from the ink supply channel than the first ink chamber sequence;

a third ink chamber sequence that is located further from the ink supply channel than the second ink chamber sequence, wherein the number of ink chambers in the first ink chamber sequence is greater than the number of ink chambers in the second ink chamber sequence, and wherein the number of ink chambers in the second ink chamber sequence is greater than the number of ink chambers in the third ink chamber sequence.

6. The ink-jet apparatus according to claim 5, wherein the n-th ink chamber sequence is the third ink chamber sequence.

7. The ink-jet apparatus according to claim 5, wherein the number of ink chambers in the third ink chamber sequence is greater than the number of ink chambers in the n-th ink chamber sequence.

8. The ink-jet apparatus according to claim 5, wherein positions of nozzles in a first nozzle sequence of the first ink chamber sequence do not overlap positions of nozzles of a second nozzle sequence of the second ink chamber sequence, when seen in a direction perpendicular to the direction in which ink flows through the ink supply channel, wherein positions of nozzles in the first nozzle sequence of the first ink chamber sequence do not overlap positions of nozzles of a third nozzle sequence of the third ink chamber sequence, when seen in a direction perpendicular to the direction in which ink flows through the ink supply channel, and wherein positions of nozzles in the second nozzle sequence of the second ink chamber sequence do not overlap positions of nozzles of a third nozzle sequence of the third ink chamber sequence, when seen in a direction perpendicular to the direction in which ink flows through the ink supply channel.

9. The ink-jet apparatus according to claim 1, wherein the ink discharging channels are not connected with any of the first to (n−1)-th ink chamber sequences.

* * * * *